US006379408B1

(12) United States Patent
Embree et al.

(10) Patent No.: US 6,379,408 B1
(45) **Date of Patent: *Apr. 30, 2002**

(54) MOUNTING AND CLOSURE STRUCTURE FOR A BAG, SUCH AS A VACUUM CLEANER BAG

(75) Inventors: Michael E. Embree, Long Beach, MS (US); Terrance M. Roberts, Fayetteville, AR (US); Paul A. Moshenrose, Ocean Springs, MS (US); William G. Fish, Gulfport, MS (US); Charles W. Reynolds, Long Beach, MS (US)

(73) Assignee: Oreck Holdings, LLC, Cheyenne, WY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/496,565

(22) Filed: Feb. 2, 2000

Related U.S. Application Data

(63) Continuation-in-part of application No. 09/287,704, filed on Apr. 6, 1999, now abandoned.

(51) Int. Cl.[7] ..... A47L 9/14

(52) U.S. Cl. ..... 55/361; 55/367; 55/369; 55/378; 55/DIG. 2; 15/347; 15/DIG. 8

(58) Field of Search ..... 55/361, 364, 367, 55/369, 373, DIG. 2, DIG. 3, 374, 378, 380, 381, 382; 15/347, DIG. 8

(56) References Cited

U.S. PATENT DOCUMENTS

| | | | | |
|---|---|---|---|---|
| 1,995,830 A | | 3/1935 | Barnsby | |
| 2,804,167 A | | 8/1957 | Seck | |
| 3,421,298 A | * | 1/1969 | Downey | 55/367 |
| 3,432,997 A | * | 3/1969 | Downey et al. | 55/367 |
| 3,724,179 A | | 4/1973 | Leinfelt | |

(List continued on next page.)

FOREIGN PATENT DOCUMENTS

| | | | | |
|---|---|---|---|---|
| DE | 34 08 564 A1 | | 9/1985 | |
| DE | 39 19 256 A1 | | 12/1990 | |
| DE | 42 37 035 A1 | | 5/1994 | |
| DE | 43 42 267 C2 | | 6/1994 | |
| EP | 0 361 240 A1 | | 4/1990 | |
| EP | 0 362 624 A1 | | 4/1990 | |
| EP | 0 499 168 A1 | | 8/1992 | |
| EP | 0 627 189 A1 | | 12/1994 | |
| JP | 05042079 | * | 2/1993 | 55/367 |
| JP | 5-154073 A | | 6/1993 | |
| JP | 5-199965 A | | 8/1993 | |
| JP | 07255651 | * | 10/1995 | 55/367 |
| JP | 08071022 | * | 3/1996 | 55/367 |
| JP | 08196491 | * | 8/1996 | 55/367 |
| JP | 10014832 | * | 1/1998 | 55/367 |
| WO | 98/22014 | | 5/1998 | |

*Primary Examiner*—Duane Smith
*Assistant Examiner*—Minh-Chau T. Pham
(74) *Attorney, Agent, or Firm*—Faegre & Benson LLP

(57) ABSTRACT

A sealable debris bag includes a bag body having an opening, and a plate member attached to the bag body proximate the opening. First and second portions of the plate member are pivotable along a fold-line so that the first portion is engageable with the second portion to substantially seal the opening. A tab on one side of the fold-line engages a notch on the other side of the fold-line to secure the device. The fold-line can be formed in the plate member, to define the first and second portions where the portions are contiguous, or can be formed in the bag body where the portions are non-contiguous. The opening may be formed in a flexible lateral wall of the bag body, or alternately, in an end portion of the bag body. A complimentary alignment structure on plate member mates with an alignment structure on a vacuum to ensure proper alignment of the debris bag on the vacuum.

50 Claims, 11 Drawing Sheets

U.S. PATENT DOCUMENTS 3,726,067 A 4/1973 Fesco
3,738,091 A 6/1973 Fesco
3,751,881 A * 8/1973 Hughes ..... 55/367
3,755,993 A 9/1973 Cote
3,803,815 A 4/1974 Anderson et al.
3,929,437 A 12/1975 Gaudry
3,933,451 A 1/1976 Johansson
4,116,648 A 9/1978 Busch
4,354,541 A 10/1982 Tilman
4,381,192 A 4/1983 Grimard
4,539,026 A 9/1985 Kuplas
4,591,369 A 5/1986 Stewart, Sr. et al.
4,678,486 A 7/1987 Jacob et al.
4,738,697 A 4/1988 Westergren
4,861,357 A 8/1989 Gavin et al.
5,028,245 A 7/1991 Stein et al.
5,045,099 A * 9/1991 Goldberg ..... 55/367
5,064,455 A 11/1991 Lackner
5,089,038 A 2/1992 Kopco et al.
5,090,975 A 2/1992 Requejo et al.
5,092,915 A 3/1992 Lackner et al.
5,158,635 A 10/1992 Schmierer et al.
5,226,941 A 7/1993 Uibel et al.
5,230,724 A 7/1993 Marafante et al.
5,464,460 A 11/1995 Bosses
5,468,272 A 11/1995 Schmierer
5,472,460 A * 12/1995 Schmierer ..... 55/367
5,472,465 A 12/1995 Schmierer
5,544,385 A 8/1996 Jailor et al.
5,688,298 A 11/1997 Bosses
5,725,620 A 3/1998 Perea et al.
5,820,643 A 10/1998 Lienenlüke et al.
6,033,451 A * 3/2000 Fish et al. ..... 55/367

* cited by examiner

MOUNTING AND CLOSURE STRUCTURE FOR A BAG, SUCH AS A VACUUM CLEANER BAG

CROSS-REFERENCE TO RELATED APPLICATION

This application is a continuation-in-part of U.S. patent application No. 09/287,704, filed on Apr. 6, 1999, now abandoned.

TECHNICAL FIELD

The present invention relates to dirt containers, for example debris bags suitable for use with a vacuum cleaner.

BACKGROUND OF THE INVENTION

Vacuum cleaners are a pervasive and well-established appliance for commercial and residential floor care. A wide variety of vacuum cleaner configurations are available to suit the needs of a particular application or user, including upright vacuums, canister models, and hand-held models. A common element in almost all vacuum cleaner configurations is a vacuum cleaner bag.

A prior art vacuum cleaner bag 20, such as the general types disclosed in U.S. Pat. No. 5,090,975 to Requejo et al., is shown in FIG. 1. In this embodiment, the vacuum cleaner bag 20 includes a bag body 22 that has two enclosed ends 24 and an opening 26 that leads to an interior region (not shown) of the bag 20. A mounting plate 28, typically constructed of cardboard, has an aperture 30 therethrough and is attached to the bag body 22 such that the aperture 30 of the mounting plate 28 aligns with the opening 26. A flexible sealing gasket 32 forms a seal between the mounting plate 28 and the bag body 22, about the opening 26.

FIG. 2 shows the vacuum cleaner bag 20 of FIG. 1 partially installed in an upright vacuum cleaner 40. The upright vacuum cleaner 40 includes a base unit 42 and a closeable bag housing or outer bag 44 attached to a handle 46. The base unit 42 typically includes an electric motor for producing suction and for rotating one or more roller brushes that dislodge dirt and particulate from a floor surface. A dirty air duct 48 is coupled with the base unit 42 and projects into the outer bag 44.

As depicted in FIG. 2, the vacuum cleaner bag 20 is installed in the vacuum cleaner 40 by opening the outer bag 44 and inserting the vacuum cleaner bag 20 into the outer bag 44. The vacuum cleaner bag 20 is coupled to the dirty air duct 48 by inserting the duct 48 through the aperture 30 of the mounting plate 28, and through the gasket 32 into the opening 26. During operation of the vacuum cleaner 40, dirt and particulate is drawn by suction into the base unit 42 and discharged through the dirty air duct 48, and are deposited into the interior region of the bag. Eventually the bag becomes filled with the dirt and particulate. The filled vacuum cleaner bag 20 is removed from the duct 48 and from the outer bag 44, and a fresh vacuum cleaner bag 20 is installed.

Although desirable and beneficial results are achievable using the vacuum cleaner bag 20, some difficulties may be encountered. For example, allergens (e.g. pollen, fungi, etc.) and fine particulate (e.g dust, skin scale, etc.) can escape the bag and be exhausted out of the vacuum cleaner if the wrong size of bag is used, or if the bag is incorrectly aligned with the duct 48. After the bag has been filled, the allergens and fine particulate may become airborne within the bag and may escape from the opening 26 during removal, transport and disposal of the bag in a waste receptacle.

Also, the bag must be carefully handled during removal from the outer bag 44. Jostling of the bag during removal occasionally causes dirt and particulate to fall into the outer bag or onto the floor surface. As a result, additional labor must be expended to re-clean the floor surface or to clean the vacuum cleaner 40.

Furthermore, the bag must be carefully handled to prevent spillage of the contents after it has been removed from the outer bag 44. If the bag has been filled above the opening 26, the bag outer bag must be positioned to ensure that the opening 26 always faces upward. Even when the bag is not filled above the opening 26, the bag member 22 must be handled carefully so that the contents of the bag member 22 are not squeezed out of the opening 26.

SUMMARY OF THE INVENTION

In one aspect, a sealable bag includes a bag body having an opening sized to receive a dirty air stream in a vacuum cleaner, and a plate member attached to the bag body proximate the opening. The plate member is composed of at least first and second portions that are pivotable with respect to one another along a fold-line so that the first portion is engagable with the second portion to substantially seal the opening in the bag body. The first and second portions are pivotable between a closed position, substantially sealing the opening in the bag body, and an open position substantially providing access to an interior of the bag body.

The fold-line can be formed in the bag body, such that the bag body forms a hinge between the first and second portions, where the first and second portions are distinct, non-contiguous members. Alternatively, the fold-line can be formed in the plate member such that a portion of the plate member forms a hinge between the first and second portions, where the first and second portions are contiguous. An aperture can extend through the plate member, sized to receive the dirty air stream and at least partially aligned with the opening. In one aspect the fold-line intersects the aperture so that the first and second portions are hingeably coupled by a pair of hinge members. In another aspect, the fold-line does not intersect the aperture so that the first and second portions are hingeably coupled by a single hinge member. The plate member includes a back surface facing the bag body, that can be scored at least partially through to define the fold-line.

A tab formed on one side of the fold-line is engagable in a slot or notch formed on the other side to secure the plate member in a sealed or closed position when folded along the fold-line.

In another aspect, the plate member includes a complimentary alignment structure, sized and positioned to mate with an alignment structure on the vacuum. The complimentary alignment structure can ensure that only the proper sized bag is mounted to the vacuum cleaner, and can further ensure that the bag is properly aligned with the vacuum cleaner's internal structure.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with bags and vacuum cleaners have not been shown or described in detail to avoid unnecessarily obscuring descriptions of the embodiments of the invention.

Figure 3:
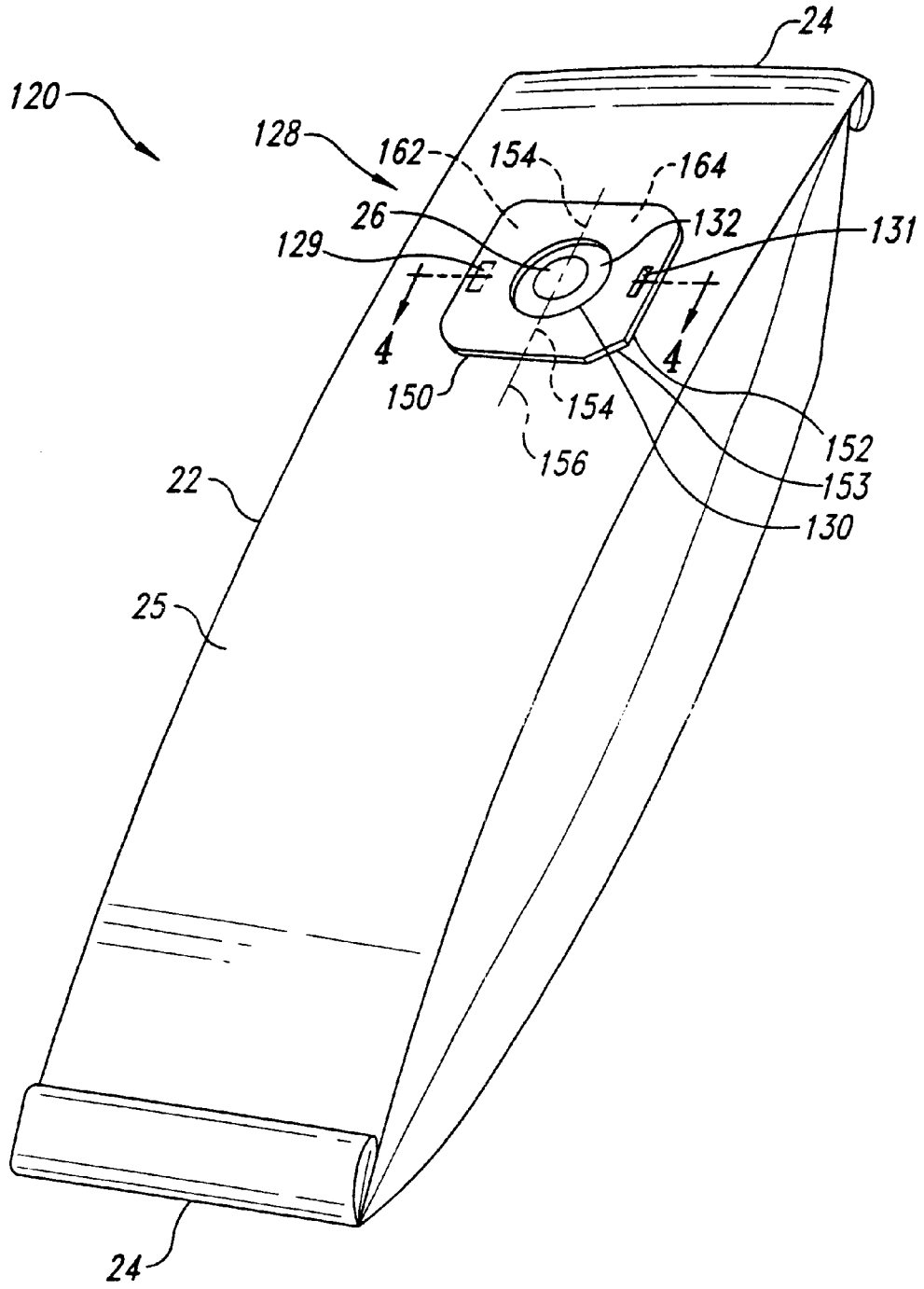
FIG. 3 is an isometric view of an embodiment of a sealable bag in accordance with the invention.

FIG. 3 shows a sealable dirt container in the form of a sealable bag 120. The sealable bag 120 includes a bag body 22 having two enclosed ends 24, a flexible lateral wall 25, and an opening 26 disposed in the flexible lateral wall 25. The opening 26 leads to an interior region of the bag or enclosure and is sized to receive a dirty air stream in a vacuum cleaner. The bag body 22 can be constructed of any suitable materials, including cellulose (i.e. paper), synthetic or natural fiber materials. Known vacuum cleaner bag materials suitable for use with the present invention include the types disclosed, for example, in U.S. Pat. No. 4,589,894 to Gin, U.S. Pat. No. 4,917,942 to Winters, and U.S. Pat. No. 5,090,975 to Requejo et al., or the treated materials used to construct the CELOC® Hypo-Allergenic filter system bag available from the Oreck Corporation of New Orleans, La.

The sealable bag 120 includes a sealing member in the form of a sealing plate 128. The sealing plate includes an aperture 130, at least partially aligned with the opening 26 in the bag body 22. In this illustrated embodiment, the sealing plate 128 is attached to the bag body 22 proximate the opening 26 with the aperture 130 concentrically disposed with respect to the opening 26. The sealing plate also includes a flexible sealing gasket 132, situated between the sealing plate 128 and the bag member 22 and disposed about the opening 26. The plate 128 can be constructed of any suitable material, including cardboard, plastic, or metal.

The sealing plate 128 includes a tab 129 and a slot or notch 131 positioned across a fold-line 156 from the tab 129. The tab 129 is formed by three slits in the sealing plate 128, forming a generally U-shape. The tab 129 can be folded along a line extending across the upper portions of the arms of the "U" to extend out of the plane of the sealing plate 128. The notch 131 is formed by one or more slits or openings in the sealing plate 128. The notch 131 is sized and dimensioned to securely receive the tab 129.

Figure 14:
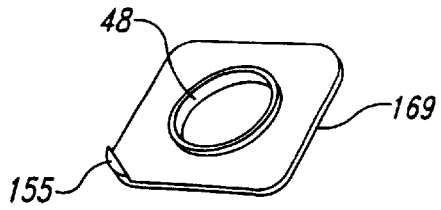
FIG. 14 is a front isometric view of a vacuum cleaner structure including a dirty air duct for use with the sealable bag apparatus of FIGS. 3–6.
Figure 15:
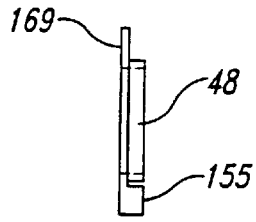
FIG. 15 is a left-side elevational view of the vacuum cleaner structure of FIG. 13.

Additionally, the sealing plate 128 includes a complimentary alignment structure in the form of a chamfered corner 153. The chamfered corner 153 is sized and positioned with respect to the aperture 130, to mate with an alignment structure 155 on a bag mounting plate 169 of the vacuum cleaner, proximate a dirty air duct 48 (FIGS. 14 and 15). By employing various shapes, positions and sizes with different style vacuums and bags, the alignment structures can ensure that the operator installs only properly sized bags on the vacuum cleaner. The mating of the alignment structure can also ensure that the operator properly aligns the bags prior to operating the vacuum cleaner. A variety of other alignment structures are disclosed throughout this detailed description. For example, the notch 131 can form a complimentary alignment structure, in addition to, or in replacement of the chamfered corner 153 where suitable alignment structure (not shown) is provided on the bag mounting plate 169.

Figure 4:
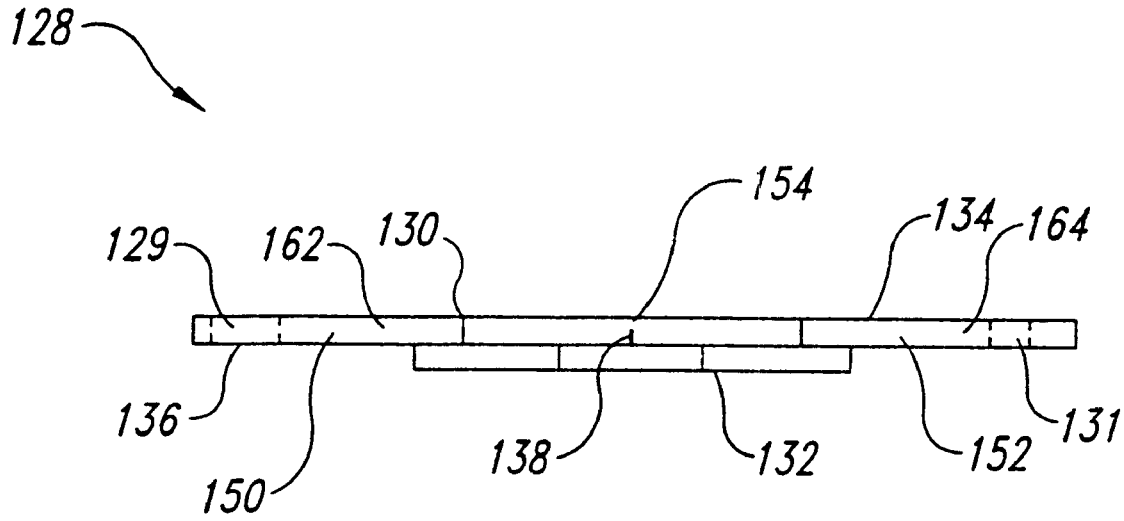
FIG. 4 is a partial sectional view of the sealing plate taken along the line 4—4 of FIG. 3.

FIG. 4 is a partial sectional view of the sealing plate 128 viewed along the line of 4—4 of FIG. 3. The sealing plate 128 has a front surface 134 facing away from the bag body 22 and a back surface 136 facing toward the bag body 22. An adhesive attaches the gasket 132 to the back surface 136 of the plate 128. A cut (or score) 138 extends partially through the back surface 136 of the plate 128, dividing the sealing plate 128 into first and second portions 150, 152, respectively.

The first and second portions 150, 152 are joined together by a pair of hinge segments 154 that are foldable along the fold-line 156 (shown in FIG. 3). The fold-line 156 divides the front surface 134 into a first surface 162 (associated with the first portion 150) and a second surface 164 (associated with the second portion 152). The tab 129 and the notch 131 are on opposite sides of the fold-line 156.

Although the sealing plate 128 is depicted in FIG. 3 as being an approximately square plate, alternate shapes may be used, including for example rectangular plates, circular or annular plates, or any other shape. Similarly, the aperture 130 need not be circular, but may be any shape, including square, rectangular, or oval.

Figure 1:
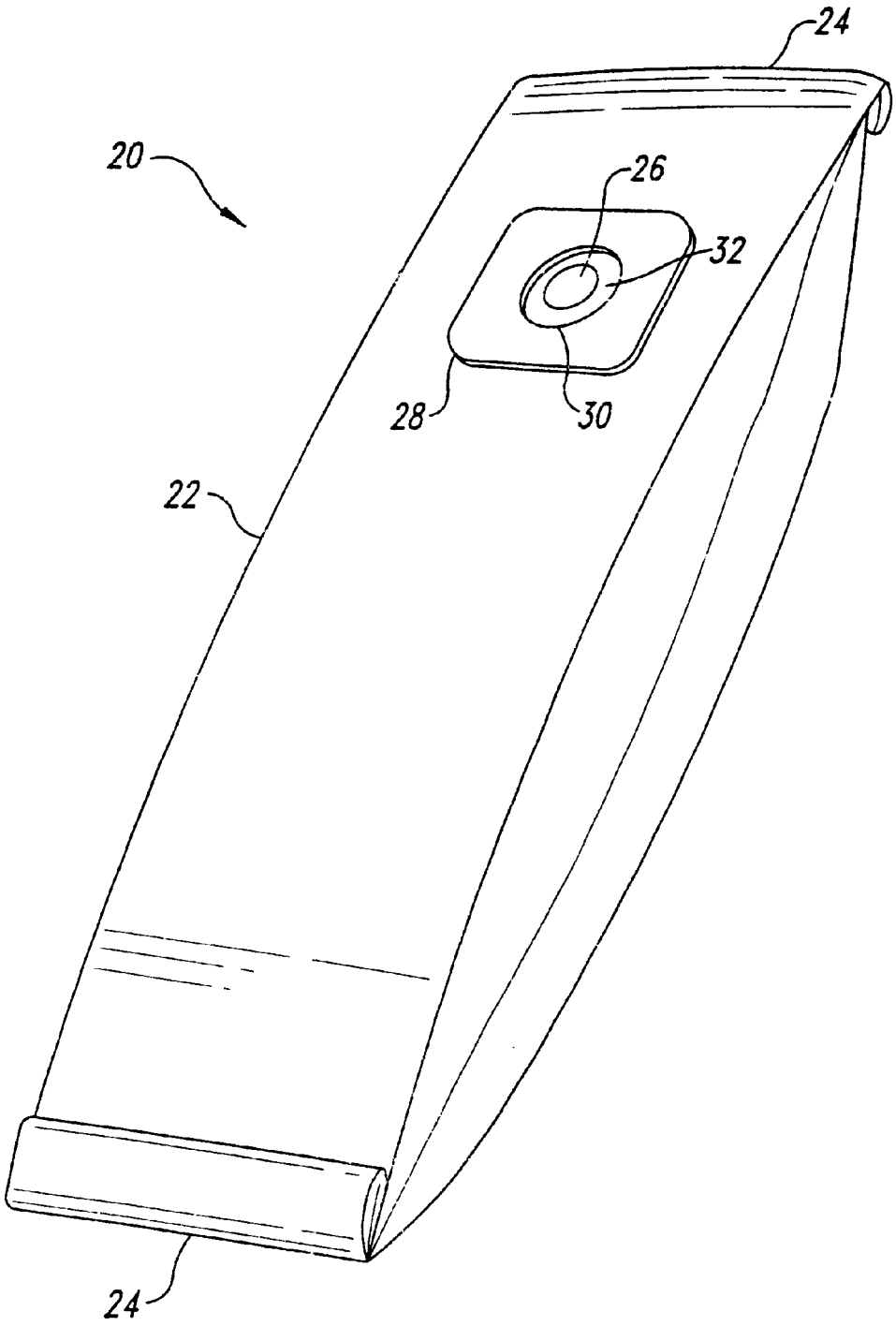
Fig. 1 (Prior Art)
FIG. 1 is an isometric view of a vacuum cleaner bag embodiment in accordance with the prior art.
Figure 2:
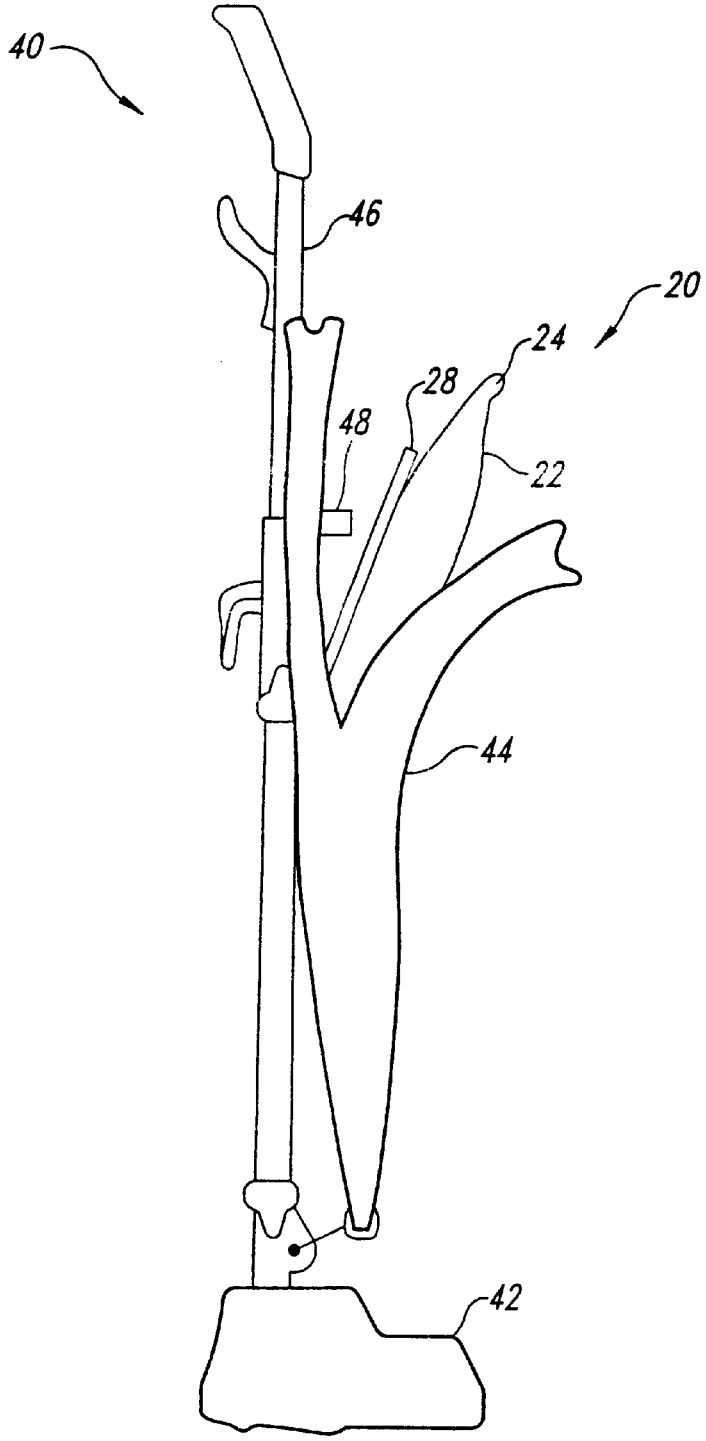
Fig. 2 (Prior Art)
FIG. 2 is a side elevational view of the vacuum cleaner bag of FIG. 1, partially installed in an upright vacuum cleaner.

In use, the sealable bag 120 is installed in a vacuum cleaner by slideably engaging the aperture 130 of the plate 128 onto the dirty air duct 48 of the vacuum cleaner 40 (shown in FIG. 2). The duct 48 projects through the aperture 130 and the gasket 132, and into the opening 26. If the chamfered corner 153 and the alignment structure 155 on the bag mounting plate 169 mate, the operator knows that the correct style and sized bag has been properly installed on the vacuum cleaner. During operation, dirt and particulate are drawn from a floor surface by the vacuum cleaner and are carried by an air stream through the duct 48 and into the sealable bag 120. When the sealable bag 120 is filled, the sealing plate 128 is disconnected from the duct 48 for proper disposal by the operator.

Figure 5:
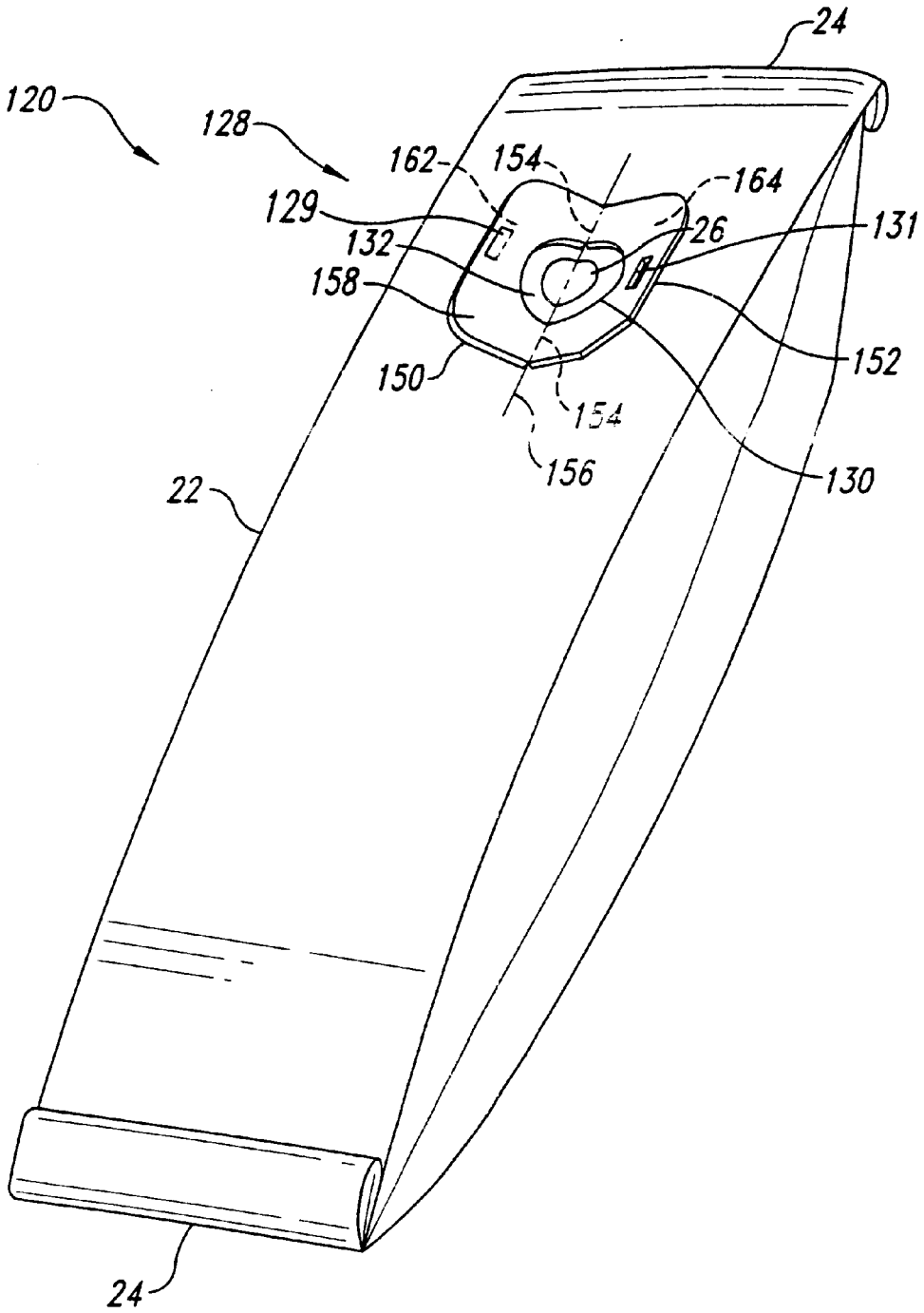
FIG. 5 is an isometric view of the sealable bag apparatus of FIG. 3 in a partially closed position.

FIG. 5 shows the sealable bag 120 in a partially closed position. To seal the sealable bag 120, the plate 128 is folded along the fold-line 156, pivoting the first portion 150 and the second portion 152 about the hinge segments 154 to move the first surface 162 toward the second surface 164. The bag member 22 remains connected to the back surface 136 of the sealing plate 128 as the first and second portions 150, 152 are folded.

Figure 6A:
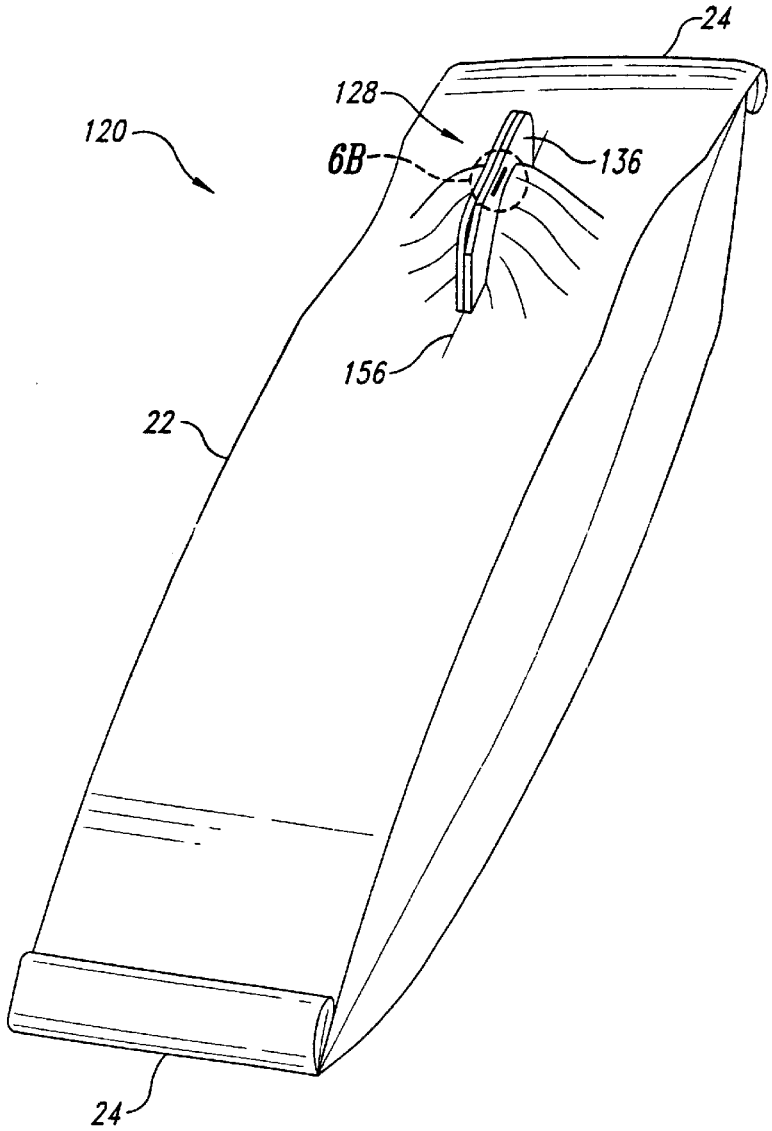
FIG. 6A is an isometric view of the sealable bag apparatus of FIG. 3 in a fully closed position.
Figure 6B:
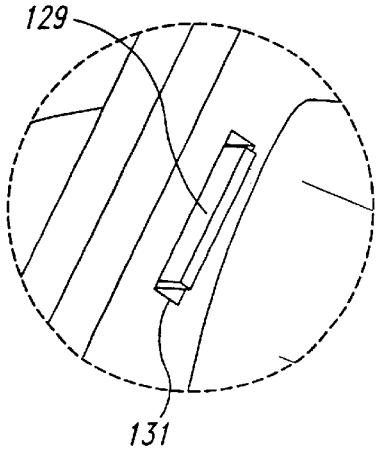
FIG. 6B is partial, enlarged view of a tab received in a notch to close the sealable bag apparatus of FIG. 6.

FIG. 6A shows the sealable bag 120 in a fully closed position. Folding the first and second portions 150, 152 about the fold-line 156 brings the first surface 162 into contact with the second surface 164 in the fully closed position. In this embodiment, the bag body 22 may become slightly distorted as the sealing plate 128 is folded about the fold-line 156 into the closed position. In the closed position, the tab 129 engages the notch 131 to secure and retain the sealing plate 128 in the closed position, as best seen in FIG. 6B. The wall of the bag body 22 surrounding the sealable aperture should be sufficiently flexible to permit the sealing mechanism to operate without rupturing the wall of the bag body 22.

Although the sealable bag apparatus 120 is shown and described above as being used in an upright vacuum cleaner, the illustrated embodiment, with or without minor modification, can work with different vacuum cleaner configurations. For example, the sealable bag apparatus 120 can operate with canister vacuum cleaners, wet-dry vacuum cleaners, hand-held vacuum cleaners, or other types of vacuum cleaners that employ a vacuum cleaner bag.

The sealable bag 120 advantageously enables the operator to seal the opening 26 of the bag after the bag has been filled with dirt, particulate, debris, etc., reducing the discharge of allergens and fine particulate that may become airborne within the bag and escape out of the opening 26. The operator's potential exposure to such allergens and fine particulate during the bag change procedure is thus reduced. Similarly, in industrial or manufacturing environments, the sealable bag 120 may advantageously reduce the presence of undesirable fine particulate.

Furthermore, the sealable bag 120 prevents the contents of the bag 22 from being spilled during handling. Because the sealable bag 120 prevents spillage, the labor associated with cleanup of the spilled contents of the bag is eliminated. After sealing the opening 26, the sealable bag 120 can be handled and transported confidently and without undue attention. In particular, the tab 129 and the notch 131 provide an easy to operate mechanism to seal the sealable bag 120. A number of simple cuts in sealing plate 128 can quickly and inexpensively form the tab 129 and notch 131 during the manufacturing process. Thus the tab 129 and notch 131 provide a simple, and easy to use, securing mechanism at a low unit cost.

Figure 7:
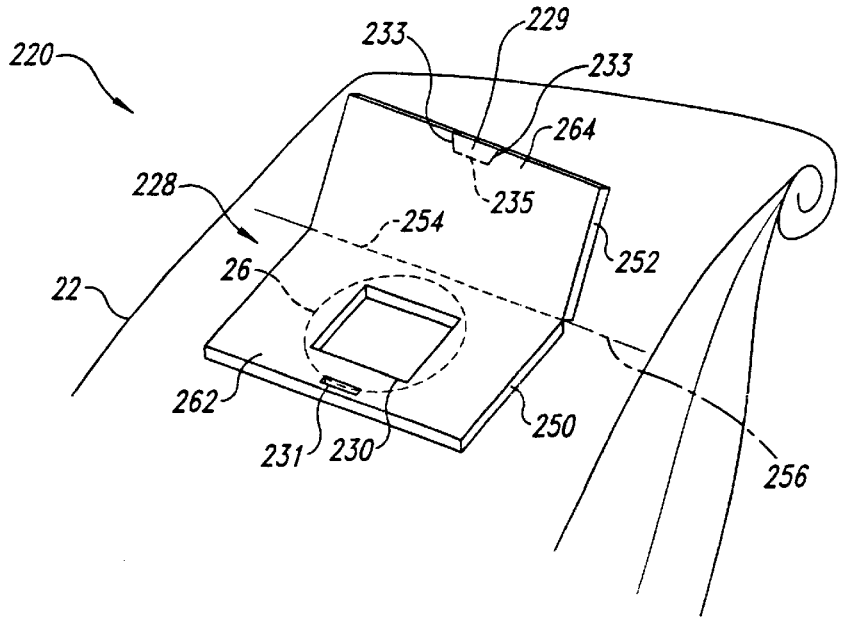
FIG. 7 is a partial isometric view of an alternate embodiment of a sealable bag apparatus in accordance with the invention.

FIG. 7 shows an alternate embodiment of a sealable bag 220 in accordance with the invention. In general, this alternative embodiment and those described in the following paragraphs are similar to previously described embodiments, and common elements and acts are identified by reference numbers having the two least significant digits in common (e.g., the reference numbers 128, 228, 328 and 428 all refer to the sealing plate in respective embodiments). Only significant differences in construction or operation are described in detail.

Figure 16:
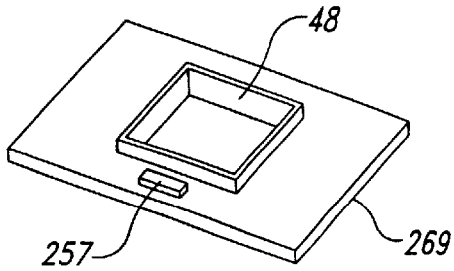
FIG. 16 is a front isometric view of a vacuum cleaner structure including a dirty air duct for use with the sealable bag apparatus of FIG. 7.
Figure 17:
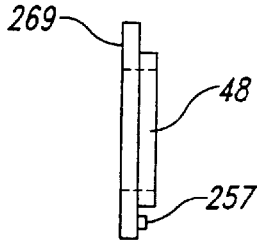
FIG. 17 is a left-side elevational view of the vacuum cleaner structure of FIG. 15.

As shown in FIG. 7, the sealable bag 220 includes a bag body 22 having an opening 26. A sealing plate 228 having a rectangular aperture 230 is attached to the bag body 22 with the aperture 230 at. least partially aligned with the opening 26. In this embodiment, however, the sealing plate 228 has a fold-line 256 that does not intersect the aperture 230. A pair of slits 233 extending to the edge of the sealing plate 228 and a hinge-line 235 across the slits 233 form the tab 229. The size and position of the notch 231 with respect to the aperture 230, as well as, the unique shape and size of the aperture 230, can serve as the complimentary alignment structure where the bag mounting plate 269 of the vacuum includes suitable alignment structure, such as projection 257 for mating therewith (FIGS. 16 and 17).

The fold-line 256 divides the sealing plate 228 into first portion and second portions 250, 252, pivotally coupled by a single hinge segment 254. The first portion 250 includes a first surface 262 and the second portion includes a second surface 264. The second portion 252 is pivotable about the hinge segment 254 so that the second surface 254 is engagable with the first surface 262 in the closed position. In FIG. 7, the second portion 252 is shown in a partially closed position with respect to the first portion 250. Only the first portion 250 of the sealing plate 228 is attached to the bag body 22.

In operation, the sealable bag 220 may be filled with dirt and particulate. When the user is ready to seal the bag body 22, the second portion 252 of the sealing plate 228 is rotated about the fold-line 256 until the second surface 264 is brought into contact with the first surface 262. The bag body 22 remains attached to the first portion 250 of the sealing plate 228. The tab 129 engages the notch 131 to secure and retain the second portion 252 in the closed position. Additionally, glue, adhesive strips, mechanical clips, interlocking fabric strips (i.e. VELCRO®), or other attachment devices may also be used to securely hold the second surface 264 in contact with the first surface 262. Thus, the aperture 230 is sealed by the second portion 252, and the contents of the bag body 22 are prevented from spilling or escaping out of the opening 26 and into the surrounding environment.

Positioning the fold-line 256 so as to not intersect the aperture 230, permits the second portion 252 to move freely of the bag body 22. Since the second portion 252 is not attached to the bag body 22, the second surface 264 can be brought into contact with the first surface 262 to seal the opening 26 without bending, folding, or distorting the bag body 22. Since the bag body 22 is not distorted when the second portion 252 is folded into the closed position, dirt and particulate are not squeezed out of the opening 26, providing a significant advantage to the operator.

Alternately, the second portion 252 of the sealing plate 228 may be sized to only partially cover the aperture 230, and a third portion (not shown) may be hingeably attached to the first portion 250 and sized to cover the remainder of the aperture 230. In this way, one or more additional portions may be utilized to cover and seal the aperture 230, and thus, seal the opening 26 of the bag body 22.

Figure 8:
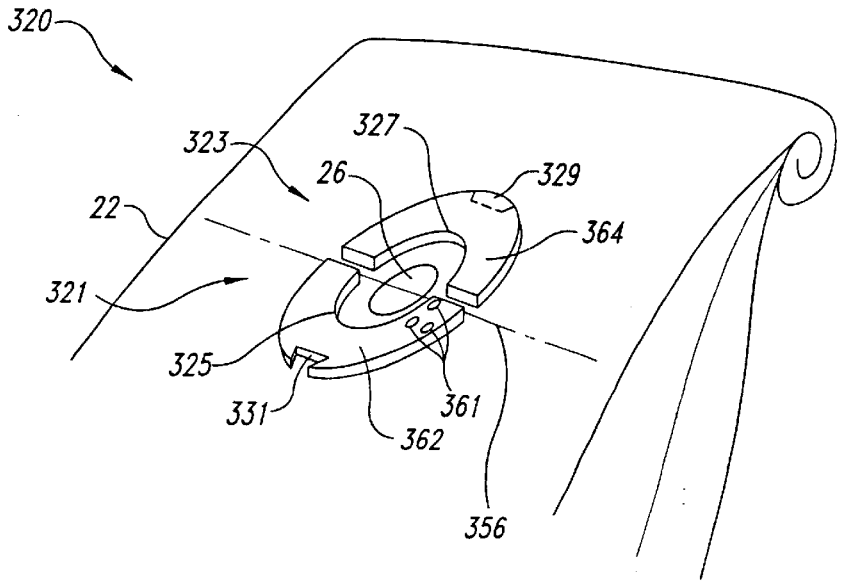
FIG. 8 is a partial isometric view of another alternate embodiment of a sealable bag apparatus in accordance with the invention.

FIG. 8 shows another alternate embodiment of a sealable bag 320 in accordance with the invention. In this embodiment, the sealable bag 320 includes a bag body 22 having an opening 26, a first semi-annular sealing plate 321 having a first surface 362, and a second semi-annular sealing plate 323 having a second surface 364, not contiguous with the first semi-annular sealing plate 321. The first and second sealing plates 321, 323 are attached to the bag body 22 proximate the opening 26. The first and second sealing plates 321, 323 each have contoured edges 325, 327, respectively, the first and second contoured edges 325, 327 cooperating to substantially surround the opening 26. A fold-line 356 in the bag body 22 divides the first and second sealing plates 321, 323. The first and second sealing plates 321, 323 are closely spaced along the fold-line 356.

Figure 18:
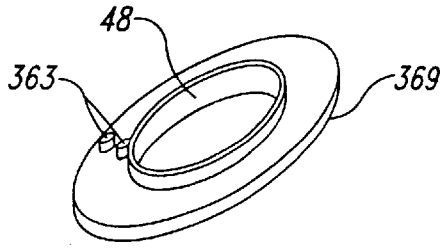
FIG. 18 is a front isometric view of a vacuum cleaner structure including a dirty air duct for use with the sealable bag apparatus of FIG. 8.
Figure 19:
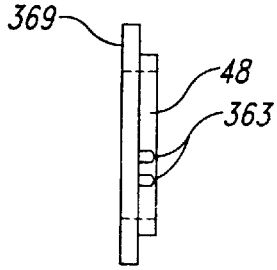
FIG. 19 is a left-side elevational view of the vacuum cleaner structure of FIG. 17.

A number of apertures 361 in the first sealing plate 321 define the complimentary alignment structure. The apertures 361 are asymmetrically aligned, forming a generally L-shape for receiving a set of pins 363 located proximate the duct 48 on the bag mounting plate 369 (FIGS. 18 and 19). The notch 331 is formed at the edge of the first sealing plate 321, while the tab 329 is formed at the edge of the second sealing plate 323.

When the operator desires to seal the opening 26 of the bag body 22, the first and second sealing plates 321, 323 are rotated about the fold-line 356, bringing the first surface 362 into contact with the second surface 364. As described above, the first and second surfaces 362, 364 may be secured together by engaging the tab 129 with the notch 131. Since the bag body 22 remains attached to the first and second sealing plates 321, 323, the opening 26 is sealed and the contents of the bag body 22 cannot escape. Thus, the above-described advantages are achievable using an apparatus having separate first and second sealing plates 321, 323.

Alternately, the first and second sealing plates 321, 323 of the sealable bag 320 might initially be joined into a single plate member, similar to the sealing plate 128 shown in FIGS. 3–6. When the user desires to seal the bag body 22, the single plate member could be separated (e.g., tearing, pulling, ripping or cutting) into the first and second sealing plates 321, 323 and closed as described above.

Figure 9:
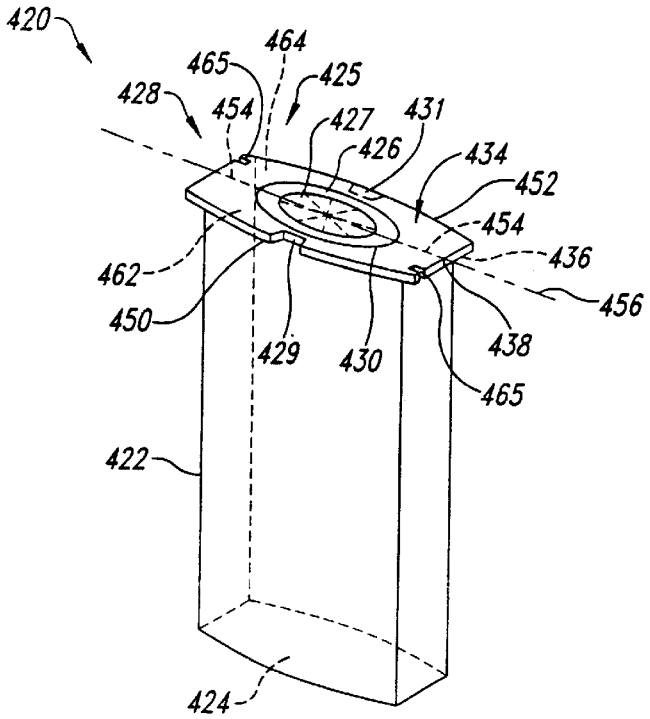
FIG. 9 is an isometric view of a further alternate embodiment of a sealable bag apparatus in accordance with the invention.

FIG. 9 shows yet another alternate embodiment of a sealable bag 420, having a bag member 422 with a closed lower end 424 and an opening 426 disposed in an upper end portion 425 of the bag member 422. A plurality of bendable, openable flaps 427 project into and partially obstruct the opening 426. A sealing plate 428 having an approximately elliptical aperture 430 is attached to the bag member 422 with the aperture 430 concentrically aligned with the opening 426.

The structure of the sealing plate 428 is similar to the structure of the previously described sealing plate embodiment 128 shown in FIGS. 3 and 4 except that the gasket 132 is omitted. In brief, the sealing plate 428 has a front surface 434 facing away from the bag body 422 and a back surface 436 facing toward the bag body 422. A cut (or score) 438 is disposed within the back surface 436 and extends only partially through the sealing plate 428, dividing the sealing plate 428 into a first portion 450 and a second portion 452.

The first portion 450 and the second portion 452 are joined together by a pair of hinge segments 454 that are pivotable along a fold-line 456. The fold-line 456 divides the front surface 434 into a first surface 462 and a second surface 464, separating the tab 429 and the notch 431. A pair of opposed slots 465 form the complimentary alignment structure. The slots 465 are preferably not symmetrical spaced with respect to the fold-line 456. For example, different sized bags can space the slots 465 at different distances from the fold-line 465 to prevent mounting an incorrect bag on the vacuum.

When a user desires to seal the sealable bag 420, the front surfaces 434 of the first and second portions 450, 452 of the sealing plate 428 are drawn together and the tab 429 engages the notch 431 to secure the first and second surfaces 462, 464 into a closed position.

Figure 10:
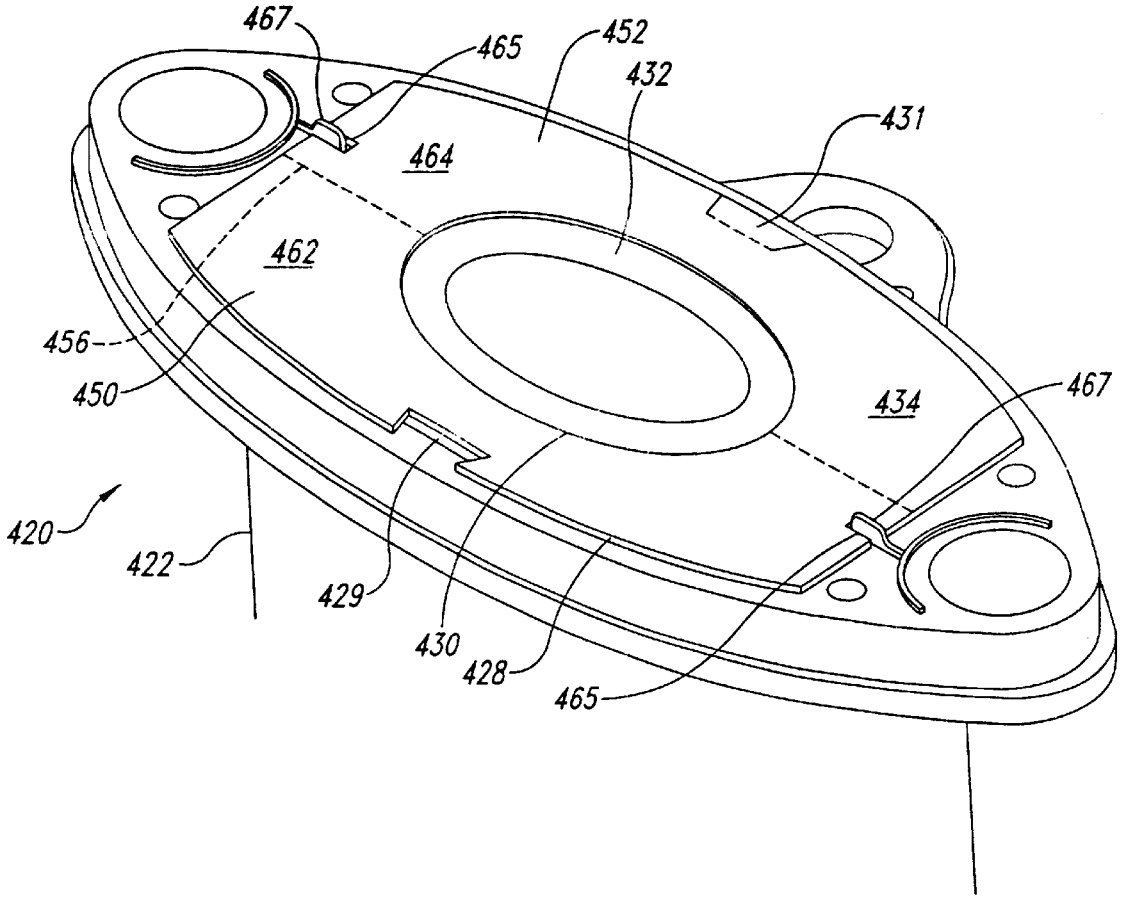
FIG. 10 is an isometric view of the sealable bag apparatus of FIG. 9 installed in an embodiment of a vacuum cleaner.

FIG. 10 shows the sealable bag 420 installed on a bag mounting plate 469 of a vacuum. The slots 465 receive projections 467 to ensure that the sealing plate 428 is correctly aligned with the bag mounting plate 469 of the vacuum. Where various alignment structures are used on different styles of vacuum cleaner, the complimentary fit of the projections and the slots can ensure that only a correctly sized bag is mounted.

Figure 11:
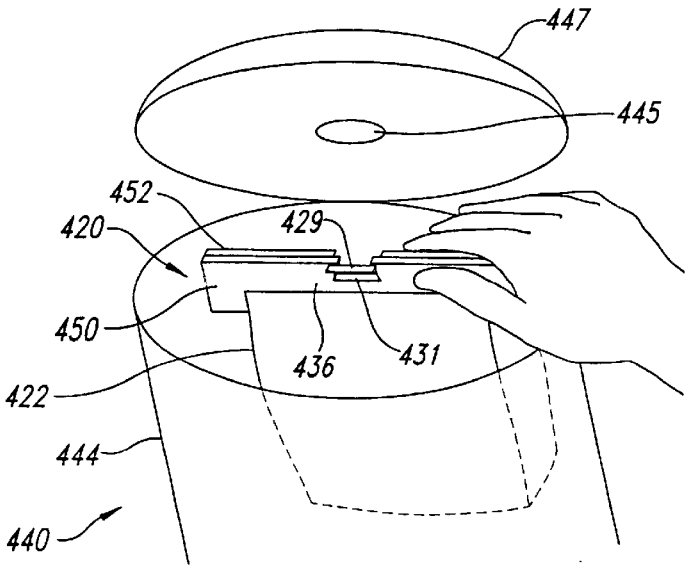
FIG. 11 is an isometric view of the sealable bag apparatus of FIG. 9 in a sealed position and being partially removed from an embodiment of a vacuum cleaner.

FIG. 11 shows the sealable bag 420 partially uninstalled in an openable housing or shell member 444 of a vacuum cleaner 440, where the bag mounting plate 469 has been omitted for clarity of the illustration. In this embodiment, dirt and particulate enter the shell member 444 through a dirty air port 445 disposed within an openable top 447 of the shell member 444, and are deposited into the bag body 422 through the aperture 430 and opening 426. In a fully installed position within the shell member 444, the sealing plate 428 of the sealable bag 420 rests upon a circumferential support lip (not shown) or any other suitable support structure on the interior of the shell member 444. Thus, the sealing plate 428 also serves to mount and support the sealable bag 420 within the shell member 444 during use of the vacuum cleaner.

In FIG. 11, the sealing plate 428 is shown in the closed position. Because the bag body 422 remains connected to the back surface 436 of the sealing plate 428 as the tab 429 engages the notch 431, the opening 426 of the bag body 422 is sealed. Thus, the user's exposure to allergens and fine particulate during removal, transport, and disposal of the sealable bag apparatus 420 is reduced. Furthermore, as shown in FIG. 11, the sealing plate 428 of the sealable bag 420 not only seals the opening 426 in the closed position, it also serves as a convenient handle for lifting and removing the filled bag body 422 from the shell member 444.

Figure 12:
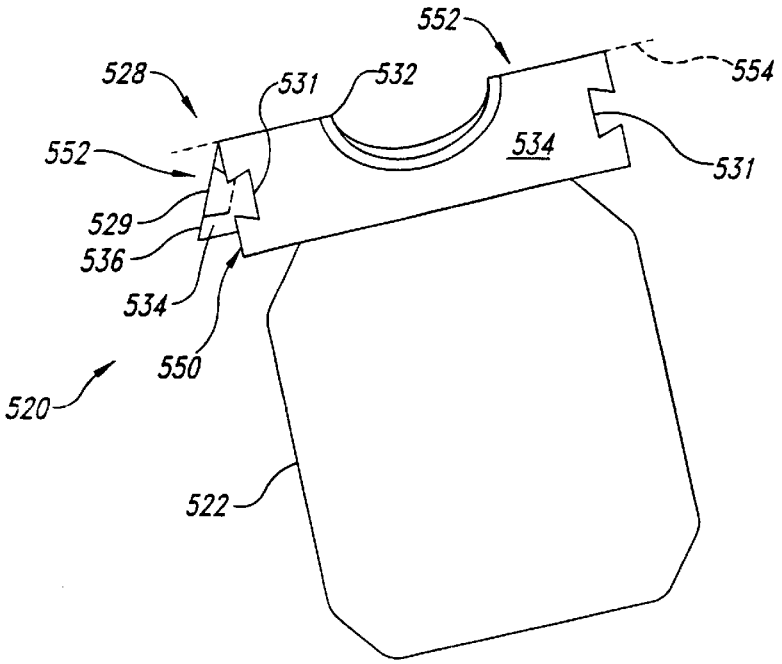
FIG. 12 is an isometric view of yet a further alternative embodiment of a sealable bag apparatus in accordance with the invention.
Figure 13:
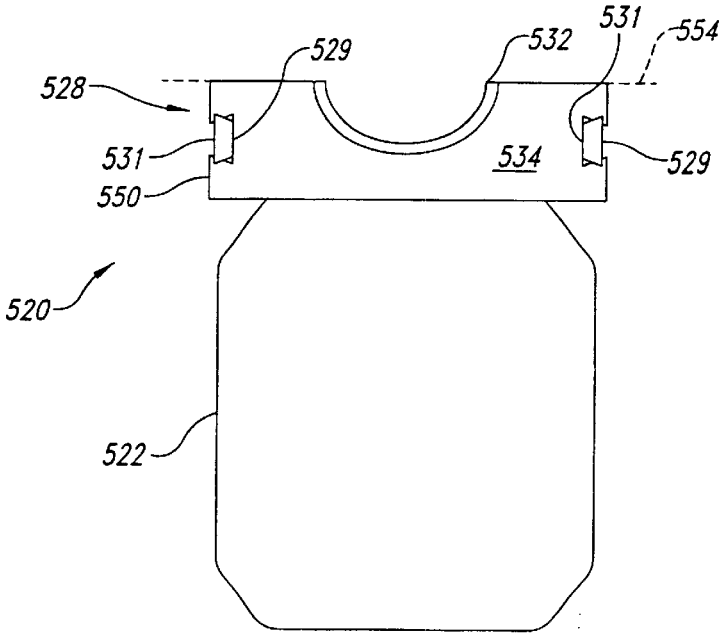
FIG. 13 is a front plan view of the sealable bag apparatus of claim 11.

FIGS. 12 and 13 show another alternative embodiment, where the back surfaces 536 of the first and second portions 550, 552 of the sealing plate 528 are drawn together, as best shown in FIG. 12. This is in contrast to the prior embodiments, where the front surfaces 536 were drawn together. The tabs 529 engage respective notches 531 formed in edges of the sealing plate 528 that are substantially perpendicular to the fold-line 556, as shown in FIG. 12.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

The sealing plate does not necessarily require a cut or score to divide the plate into a first and second portions. A fold, crease or narrowing of the plate can adequately form the fold-line that divides the plates.

The front surface 134 of the sealing plate 128 may additionally be coated with an adhesive layer 158, as taught in commonly assigned U.S. Ser. No. 09/287,704, filed Apr. 6, 1999, and entitled "Vacuum Cleaner Bag Closure" (Attorney Docket No. 720093.459), incorporated herein by reference. Also, a removable, non-stick sheet 160, formed by a sheet having a non-stick coating on one surface, may be used to cover adhesive layer 158 and is shown in a partially removed position in FIG. 3.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other sealable dirt containers, and not just to the sealable bags for use with vacuum cleaners described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

We claim:

1. A vacuum cleaner debris collecting bag, comprising:

a flexible porous wall forming an enclosure to trap a particulate and to pass air, the porous wall forming an opening sized to receive a flow of air containing a particulate; and a plate secured to the porous wall, the plate having an aperture at least partially aligned with the opening in the porous wall to permit the flow of air containing the particulate to enter the enclosure, a fold-line extending across the plate and intersecting the aperture, the plate having a tab and a notch opposed to the tab across the fold-line, the notch being sized to securingly receive the tab when the plate is folded along the fold-line, the plate further having a chamfered corner adapted to engage an alignment protrusion on a vacuum cleaner when the plate is properly engaged with the vacuum cleaner.

2. The vacuum cleaner debris collecting bag of claim 1 wherein the plate has an outer surface and an inner surface opposed to the outer surface, the outer surface adjacent the porous wall, the inner surface having a first portion and a second portion separated by the fold-line, the first portion of the inner surface being adjacent the second portion of the inner surface in the closed position.

3. The vacuum cleaner debris collecting bag of claim 1 wherein the plate has an outer surface and an inner surface opposed to the outer surface, the inner surface adjacent the porous wall, the inner surface having a first portion and a second portion separated by the fold-line, the first portion of the inner surface being adjacent the second portion of the inner surface in the closed position.

4. The vacuum cleaner debris collecting bag of claim 1, further comprising:

a elastomeric sealing gasket mounted about the aperture of the plate.

5. The vacuum cleaner debris collecting bag of claim 1 wherein a pair of slits taper inward from an edge of the plate to form the tab.

6. The vacuum cleaner debris collecting bag of claim 1 wherein a tapered cut-out at an edge of the plate forms the notch.

7. A debris collecting bag, comprising:

a flexible enclosure having an opening;

a first sealing portion secured to the enclosure proximate the opening; and a second sealing portion opposed across a fold-line from the first sealing portion, the second sealing portion movable about the fold-line with respect to the first sealing portion between a closed position adjacent the first sealing portion at least partially covering the opening and an open position spaced from the closed position, where one of the first and second sealing portions have a tab and the other of the first and second sealing portions have a notch sized to securingly receive the tab in the closed position, the notch and the tab being on opposite sides of the fold-line from one another, at least one of the first and second sealing portions having a contoured alignment edge adapted to engage an alignment structure on a floor care apparatus when the debris collecting bag is properly engaged with the floor care apparatus.

8. The debris collecting bag of claim 7 wherein the first and second sealing portions are each formed from a separate sheet of material and the fold-line is formed in the flexible enclosure between the sheets of material.

9. The debris collecting bag of claim 7 wherein the first and second sealing portions are formed from a continuous sheet of material and the fold-line is formed in the sheet of material.

10. The debris collecting bag of claim 7 wherein the first and second sealing portions are formed from a continuous sheet of material having an aperture therethrough aligned with the opening, and the fold-line is formed in the sheet of material spaced from the aperture.

11. The debris collecting bag of claim 7 wherein the first and the second sealing portions are formed from a continuous sheet of material having an aperture therethrough aligned with the opening, and the fold-line is formed in the sheet of material intersecting the aperture.

12. The debris collecting bag of claim 7 wherein the first and second sealing portion forms an aperture at least partially aligned with the opening to form a passage when the second sealing portion is in the open position.

13. The debris collecting bag of claim 7 wherein the first and second sealing portions each form an aperture at least partially aligned with the opening to form a passage when the second sealing portion is in the open position.

14. A debris collecting bag, comprising:

a flexible enclosure of a porous material having an opening sized to receive a dirty air flow; and a stiff plate attached to the flexible enclosure, the stiff plate having an aperture at least partially aligned with the opening in the flexible enclosure, the stiff plate further having a fold-line extending there across to form a first portion having a tab and a second portion having a notch sized to engage the tab, the first and second portions movable with respect to one another between an open position in which the aperture provides a passage to the opening in the flexible enclosure and a closed position in which the aperture closes the passage to the opening, the plate having a contoured alignment edge adapted to engage an alignment structure on a floor care apparatus when the debris collecting bag is properly engaged with the floor care apparatus.

15. The debris collecting bag of claim 14 wherein a first surface of the plate is adjacent the flexible enclosure and the first surface is folded back on itself when the plate is folded along the fold-line.

16. The debris collecting bag of claim 14 wherein a first surface of the plate is adjacent the flexible enclosure and a second surface of the plate is folded back on itself when the plate is folded along the fold-line.

17. A sealing member for a debris bag, comprising:

a plate having an aperture formed therethrough and a fold-line extending across the plate, a tab formed on one side of the fold-line line and a notch sized and dimensioned for securingly receiving the tab formed opposite the tab on another side of the fold-line, the plate having a contoured alignment edge adapted to engage an alignment structure on a floor care apparatus when the debris bag is properly engaged with the floor care apparatus.

18. The sealing member of claim 17 wherein the fold-line intersects the aperture.

19. The sealing member of claim 17, further comprising:

an elastomeric sealing gasket mounted about at least a portion of the aperture of the plate and extending radially inwardly therefrom.

20. The sealing member of claim 17 wherein a pair of slits extending inward toward the aperture from an edge of the plate form the tab.

21. The sealing member of claim 17 wherein a pair of slits extending inward toward the aperture from an edge of the plate form the tab, the tab being tapered.

22. The sealing member of claim 17 wherein a single slit forms the notch.

23. The sealing member of claim 17 wherein the plate is formed of cardboard.

24. The sealing member of claim 17 wherein a crease in at least one surface of the plate forms the fold-line.

25. The sealing member of claim 17 wherein a score in at least one surface of the plate forms the fold-line.

26. The sealing member of claim 17 wherein a series of perforations in at least one surface of the plate forms the fold-line.

27. The sealing member of claim 17 wherein the tab is diametrically opposed from the notch across the aperture.

28. The sealing member of claim 17 wherein the tab and the notch are on an edge of the plate that is substantially perpendicular to the fold-line.

29. A debris bag for use in a vacuum cleaner having an air duct and an alignment structure proximate the air duct, the debris bag comprising:

a bag body having an opening sized to receive a flow of dirty air from the air duct; and a sealing plate having an aperture at least partially aligned with the opening in the bag body and sized to receive the air duct, the sealing plate having a fold-line extending thereacross, a tab formed on one side of the fold-line line, and a notch sized and adapted for securingly receiving the tab formed opposite the tab on another side of the fold-line when the sealing plate is folded about the fold-line, the sealing plate further having a complimentary alignment structure positioned with respect to the aperture and shaped to fit the alignment structure of the vacuum.

30. The debris bag of claim 29 wherein the complimentary alignment structure of the sealing plate comprises at least one slot dimensioned to closely receive the alignment structure of the vacuum cleaner.

31. The debris bag of claim 29 wherein the complimentary alignment structure of the sealing plate comprises a pair of slots asymmetrically arranged with respect to the aperture and dimensioned to closely receive the alignment structure of the vacuum cleaner.

32. The debris bag of claim 29 wherein the alignment structure of the vacuum comprises at least one projection and the complimentary alignment structure of the sealing plate comprises at least one slot dimensioned to closely receive the alignment structure of the vacuum cleaner.

33. The debris bag of claim 29 wherein the alignment structure of the vacuum comprises at least one projection and the complimentary alignment structure of the sealing plate comprises two slots asymmetrically arranged with respect to the exhaust duct and dimensioned to closely receive the alignment structure of the vacuum cleaner.

34. The debris bag of claim 29 wherein the complimentary alignment structure of the sealing plate comprises at least one aperture positioned and dimensioned to closely receive the alignment structure of the vacuum cleaner.

35. The debris bag of claim 29 wherein the alignment structure of the vacuum comprises at least one pin and the complimentary alignment structure of the sealing plate comprises at least one aperture dimensioned to closely receive the alignment structure of the vacuum cleaner.

36. The debris bag of claim 29 wherein the complimentary alignment structure of the sealing plate is shaped to receive the alignment structure of the vacuum cleaner.

37. The debris bag of claim 29 wherein the complimentary alignment structure of the sealing plate is shaped to be received by the alignment structure of the vacuum cleaner.

38. A method of forming a debris collecting bag, comprising:

forming an aperture in a plate;

forming a contoured alignment edge in the plate wherein the alignment edge is adapted to engage with an alignment structure of a floor care apparatus when the debris collecting bag is properly engaged with the floor care apparatus;

forming a tab on the plate;

forming a notch sized and dimensioned to receive the tab on the plate;

forming a fold-line extending across the plate, the fold-line separating the tab from the notch; and securing the plate to a flexible enclosure, the aperture of the plate at least partially aligning with an opening in the flexible enclosure.

39. The method of claim 38, further comprising:

securing an elastomeric sealing gasket about at least a portion of the aperture of the plate and extending radially inwardly therefrom.

40. The method of claim 38 wherein forming a fold-line includes scoring the plate on an outer surface opposite from the flexible enclosure so that an inner surface adjacent the flexible enclosure is foldable inwardly toward itself to seal the flexible enclosure.

41. The debris collecting bag of claim 7 wherein the contoured alignment edge comprises a chamfered corner.

42. The debris collecting bag of claim 7 wherein the contoured alignment edge comprises an elongated slot and the alignment structure comprises an elongated projection engageable within the elongated slot.

43. The debris collecting bag of claim 14 wherein the contoured alignment edge comprises a chamfered corner.

44. The debris collecting bag of claim 14 wherein the contoured alignment edge comprises an elongated slot and the alignment structure comprises an elongated projection engageable within the elongated slot.

45. The debris collecting bag of claim 17 wherein a first surface of the plate is adjacent the flexible enclosure and the first surface is folded back on itself when the plate is folded along the fold-line.

46. The debris collecting bag of claim 17 wherein the contoured alignment edge comprises a chamfered corner.

47. The debris collecting bag of claim 17 wherein the contoured alignment edge comprises an elongated slot and the alignment structure comprises an elongated projection engageable within the elongated slot.

48. The debris collecting bag of claim 29 wherein the complimentary alignment structure comprises a chamfered corner.

49. The method of claim 38 wherein forming a contoured alignment edge in the plate comprises forming a chamfered corner.

50. The method of claim 38 wherein forming a contoured alignment edge in the plate comprises forming an elongated slot adapted to engage with an elongated projection of a floor care apparatus.

* * * * *